US005953966A

United States Patent [19]

Spirer

[11] Patent Number: 5,953,966

[45] Date of Patent: Sep. 21, 1999

[54] HAND WRENCH WITH TORQUE AUGMENTING MEANS

[76] Inventor: Steven E Spirer, 391 Haworth Ave., Haworth, N.J. 07641

[21] Appl. No.: 08/965,546

[22] Filed: Nov. 6, 1997

[51] Int. Cl.[6] ..... B25B 17/00; B25B 13/46; B25B 13/00

[52] U.S. Cl. ..... 81/57.3; 81/57.39; 81/58; 81/60

[58] Field of Search ..... 81/57.39, 58, 60, 81/57.42, 57.3, 62

[56] References Cited

U.S. PATENT DOCUMENTS

| | | | |
|---|---|---|---|
| 1,327,991 | 1/1920 | Gatewood | 81/57.3 |
| 1,346,505 | 7/1920 | Mitchell | 81/57.3 |
| 1,522,839 | 1/1925 | Rogers . | |
| 2,204,800 | 6/1940 | Freeborn . | |
| 2,235,192 | 3/1941 | Bailey . | |
| 2,238,125 | 4/1941 | Murray . | |
| 2,292,079 | 8/1942 | Joyce . | |
| 2,296,532 | 9/1942 | Mekeel, Jr. . | |
| 2,653,489 | 9/1953 | Charpentier . | |
| 2,655,015 | 10/1953 | Linder . | |
| 2,742,797 | 4/1956 | Perham . | |
| 2,783,657 | 3/1957 | Kohlhagen . | |
| 2,882,757 | 4/1959 | Edsall . | |
| 3,363,482 | 1/1968 | Cage . | |
| 3,364,794 | 1/1968 | Ishoika . | |
| 3,447,404 | 6/1969 | Lachance | 81/54 |
| 3,564,953 | 2/1971 | Able | 81/57.3 |
| 3,722,325 | 3/1973 | Rogers . | |
| 4,041,835 | 8/1977 | Isler . | |
| 5,584,220 | 12/1996 | Darrah et al. | 81/57.29 |
| 5,732,605 | 3/1998 | Mann | 81/57.3 |

*Primary Examiner*—David A. Scherbel
*Assistant Examiner*—Philip J. Hoffmann
*Attorney, Agent, or Firm*—Weingram & Associates, P.C.

[57] ABSTRACT

A hand held torque wrench with augmenting means is provided which includes a linkage assembly to join a drive input with an output wrench socket. The linkage assembly consists of a drive link extending from the input socket and coacting with a conversion link extending to a ratchet disposed about the output socket of the device. Rotation of the drive link pivots the conversion link to transfer torque from the input to the output socket. A pawl on the driven link is provided to coact with a ratchet which encircles the output socket. A guide means is disposed in the interior of the housing of the device to coact with the linkage assembly to maintain proper alignment during a torque operation, such that stress and force are substantially reduced or dissipated, if not eliminated, during the operation.

38 Claims, 7 Drawing Sheets

HAND WRENCH WITH TORQUE AUGMENTING MEANS

BACKGROUND OF THE INVENTION

1. Field of the Invention

The present invention relates to torquing apparatus and in particular, to hand operated apparatus adapted to transmit and/or augment torque from an input through to an output of the apparatus.

2. Description of the Related Art

Wrenches are among the most useful handtools and their design often has conflicting objects. The primary purpose of a wrench is to apply torque to a nut or other fastening device to seat or unseat the device in threaded engagement with a mating object. In order to apply large amounts of torque, wrenches normally have to be either very large in size or use auxiliary mechanisms such as hydraulic or mechanical apparatus to increase the torque provided by the wrench. This tends to make the wrench bulky and large and limit its effectiveness for normal everyday use where the object is to provide a wrench that is relatively small, can fit into tight places and is easy and convenient to use. Examples of torque augmenting devices are known and disclosed in the prior art as follows:

| U.S. Pat. No. | Inventor(s) |
|---|---|
| 1,522,839 | Rogers |
| 2,204,800 | Freeborn |
| 2,235,192 | Bailey |
| 2,238,125 | Murray |
| 2,292,079 | Joyce |
| 2,296,532 | Mekeel, Jr. |
| 2,653,489 | Charpentier |
| 2,655,015 | Linder |
| 2,742,797 | Perham |
| 2,783,657 | Kohlhagen |
| 2,882,757 | Edsall |
| 3,363,482 | Case |
| 3,364,794 | Ishoika |
| 3,722,325 | Rogers |
| 4,041,835 | Isler |

For example, U.S. Pat. No. 2,296,532 to Mekeel, Jr. discloses a torque control transmission having a reaction brake which includes a ratchet wheel and latch, and a reversing brake with oppositely facing ratchet wheel and latch. Connector arms support the latches and are pivotally operated by a lever.

U.S. Pat. No. 2,783,657 to Kohlhagen discloses a constant torque drive having a plurality of gears arranged between a pair of plates, and a pawl pivotally mounted on one of the gears and urged by a spring into operative engagement with a disc-shaped head of a stud to lock the gears against counterclockwise rotation, but permit their rotation in a clockwise direction. The gears are supported by an arm which is connected to a spring to urge the arm in a certain direction.

U.S. Pat. No. 3,364,794 to Ishoika discloses a spring torque converter having a plurality of rocking levers, pairs of which are connected with links for coaction with the drive shaft and driven shaft to apply torque. Another embodiment discloses a plurality of crank pins, and a helical spring having one end attached to the respective crank pin and another end attached to an anchoring pin on a carrier portion of the device.

The remaining patents also disclose other torquing devices.

OBJECTS AND SUMMARY OF THE INVENTION

The present invention provides a simple, efficient and light weight wrench With torque augmenting means. Disclosed is a socket wrench which utilizes a rachet arrangement commonly used in wrenches and which includes additional features within the handle of the wrench that enable an auxiliary unit to be connected to the wrench to augment the torque provided by the wrench when situations requiring high torque are encountered. The apparatus is constructed in a manner to facilitate effective coaction of the various components without placing undue stress on the housing and handle of the wrench which enables the wrench to be relatively small for the job it can perform and relatively light and easy to use.

It is an object of the present invention to provide an augmenter which can be used in confined spaces, and has an envelope sized approximately the same as a standard wrench socket to fit in an area between adjacent nuts.

It is another object of the present invention to provide a hand wrench augmenter which can operate as a hand wrench or as a plain wrench without any force augmentation.

It is another object of the present invention to provide a hand wrench having means to enable additional torque to be transmitted to the hand wrench, which in turn is converted to torque at the wrench engaging portion of the apparatus to augment the total torque that can be exerted by the wrench.

It is another object to the present invention to provide a hand wrench with torque augmenting means which can function either as a hand wrench or as a high torque tightening apparatus of limited travel independently of each other.

It is another object of the present invention to provide a hand wrench augmenter which can be augmented in multiple positions and from either side.

It is an object of the present invention to provide a hand wrench which is adapted for use with a separate input drive to transmit torque to an output drive such as a socket.

It is another object of the present invention to provide a hand wrench which is of simple construction, easy to maintain and repair, and adapted to receive differently sized input drives to transmit torque to the output drive.

It is another object of the present invention to provide a hand wrench constructed with linkage to transmit and convert the torque at the input receptacle to the output drive.

It is another object of the present invention to provide a hand wrench which is operable without external gears or hydraulics.

It is another object of the present invention to provide a hand wrench constructed with a housing in which a guide means is disposed to substantially reduce, if not eliminate, forces at an interior portion of the housing and the linkage within the housing, such that the structural integrity of the housing is maintained.

It is another object of the present invention to provide a hand wrench constructed with a housing having side walls arranged to absorb the force of the internal linkage during an operation of the apparatus.

It is another object of the present invention to provide a hand wrench having a housing in which a biasing means is arranged to automatically urge the linkage to reset for a subsequent torque transmission/converter operation.

It is another object of the present invention to provide a hand wrench having indicia disposed at an exterior of the housing to indicate to a user when the linkage has reached the extent of its "throw" for the torquing operation, and is to recoil for a subsequent torquing operation.

BRIEF DESCRIPTION OF THE DRAWINGS

For a more complete understanding of the present invention, reference may be had to the detailed description of preferred embodiments taken in conjunction with the accompanying drawings, of which.

DETAILED DESCRIPTION OF THE PREFERRED EMBODIMENTS

Figure 1:
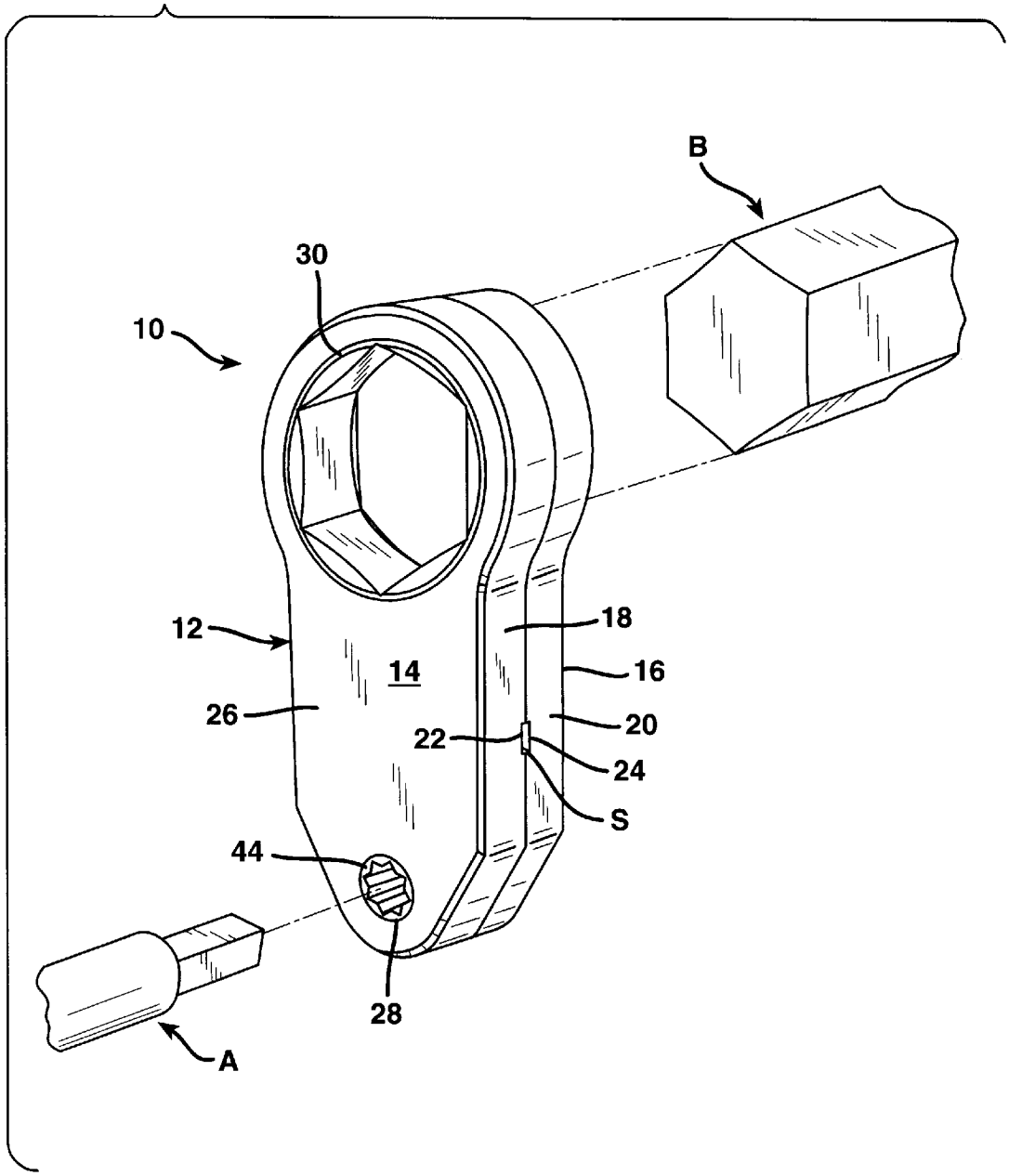
FIG. 1 is a perspective view showing a hand wrench with torque augmenting means according to the present invention.
Figure 2:
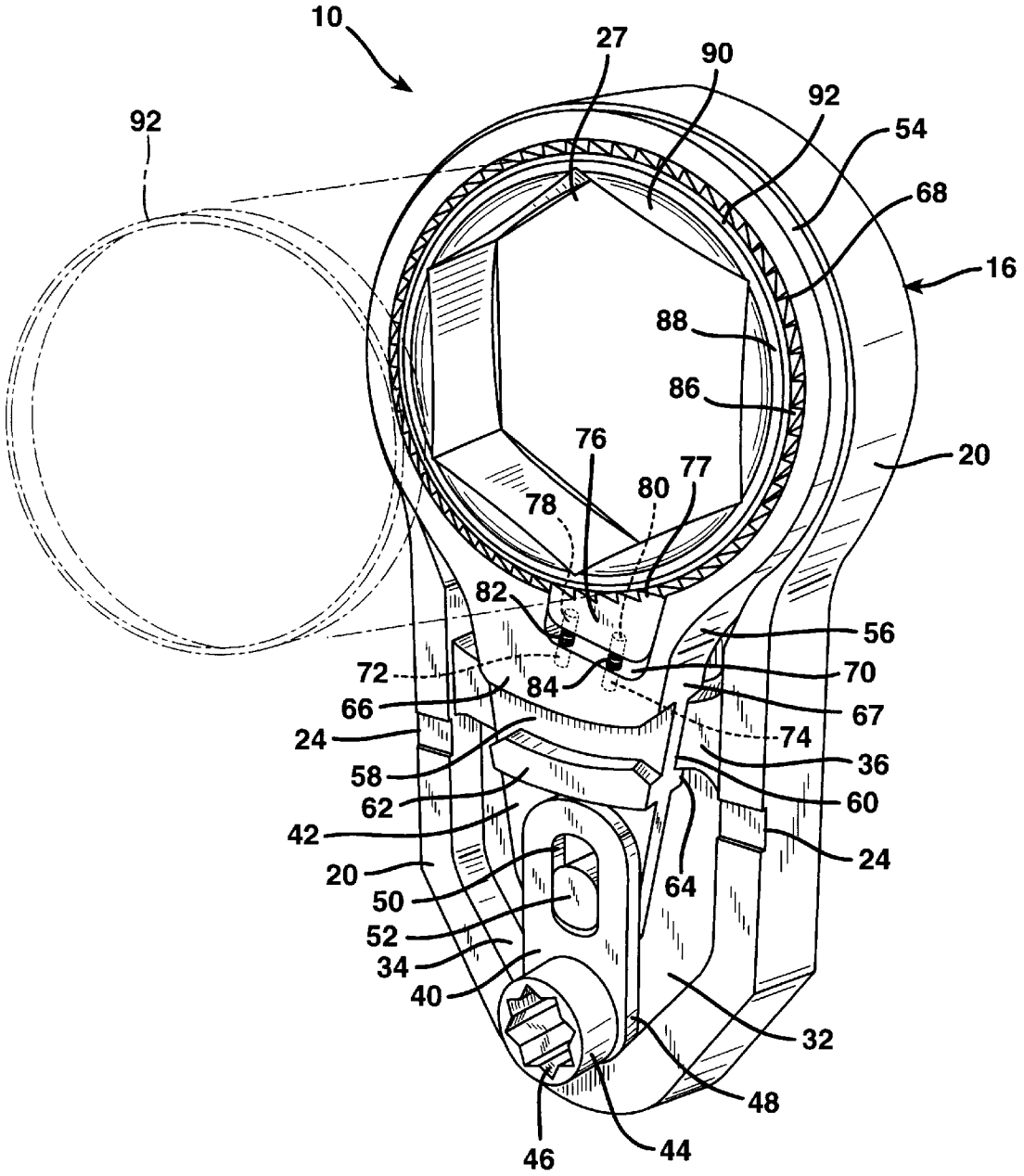
FIG. 2 is a top perspective view showing internal elements of the hand wrench.

Referring to FIGS. 1 and 2, a hand wrench having torque augmenting means of the present invention is shown generally at 10. The augmenter 10 is constructed to receive an external drive input A and transmit or augment the torque from the input A to an output B, such as a hex-sided stud or bolt.

The augmenter 10 consists of a housing 12 which is constructed from a pair of halves 14,16. The halves 14,16 can be held together by conventional mechanical fasteners such as screws, or with a friction fit. Each one of the halves 14,16 is provided with a continuous side wall 18,20 in which a corresponding detent or cutout 22,24 is formed. When the halves 14,16 are brought together to form the housing 12, the cutouts 22,24 formed in the respective side walls 18,20 are aligned in registration with each other to provide a space S at which force can be exerted to part the halves 14,16.

The half 14 has an exterior surface 26 upon which printed indicia can be displayed. The indicia can be instructions for operating the tool, logos, safety notices, etc. The half 16 has an exterior surface also for printed indicia which is not shown due to the perspective of the drawing Figures.

The half 14 is constructed with a small aperture 28 at one end thereof, the aperture 28 extending from the surface 26 completely through the half 14. An opposite end of the half 14 is formed with a larger aperture 30 which similarly extends from the surface 26 completely through the half 14.

Figure 3:
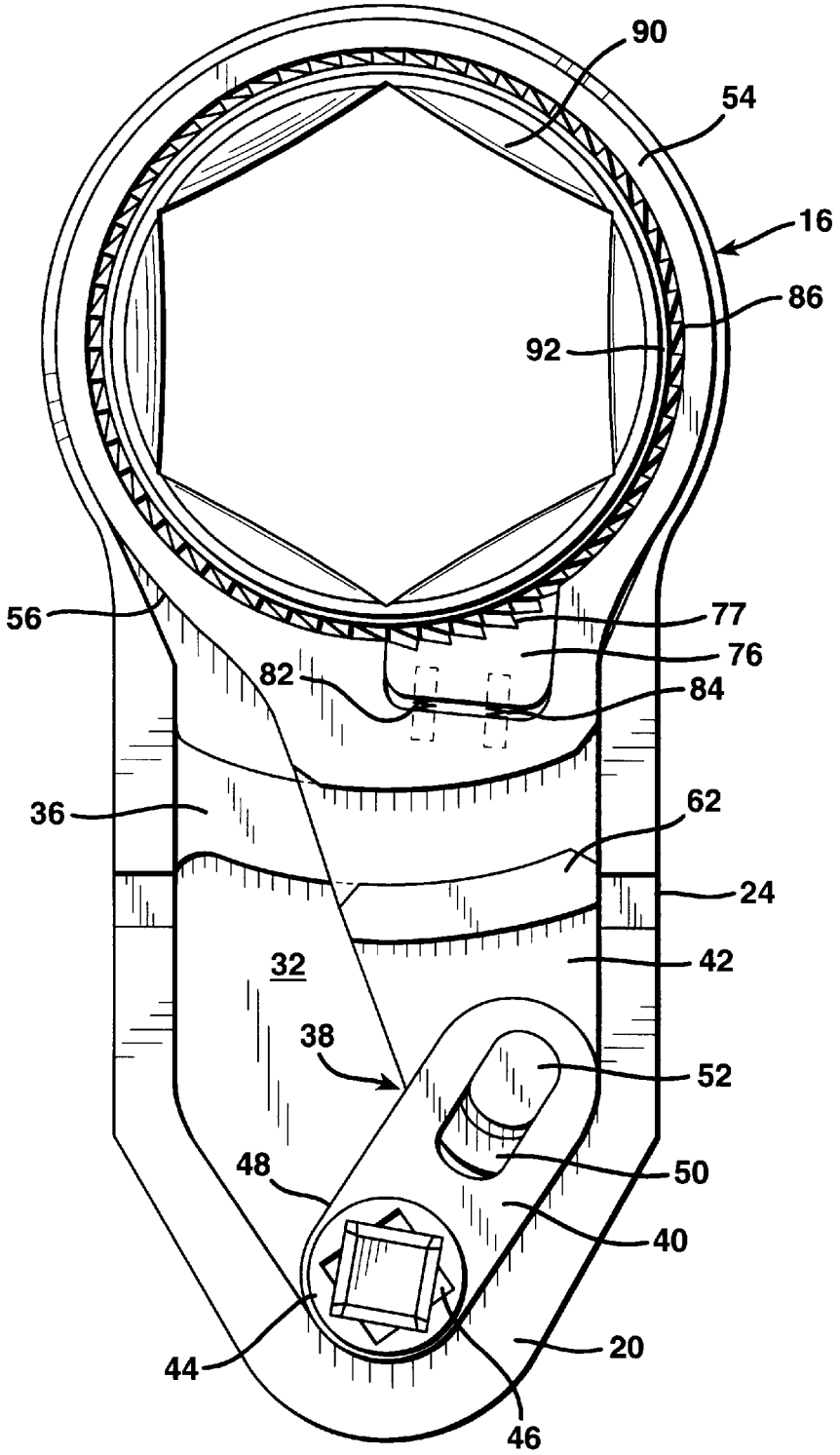
FIG. 3 is a top plan view showing the hand wrench at rest for a torque operation.

Referring also to FIGS. 2 and 3, additional elements of the augmenter 10 are also disclosed.

The half 16 includes an interior floor 32 from which the continuous side wall 20 extends upward therefrom. The side wall 20 is provided with an inner surface 34. An arcuate guide bar 36 extends upward from the floor 32. The guide bar 36 extends across the floor 32 such that each one of the opposed ends of the guide bar 36 is connected to a corresponding portion of the inner surface 34 of the continuous side wall 20 at opposite sides of the floor 32.

In FIG. 3, the augmenter 10 of the present invention is shown at rest ready to commence a torque operation. The elements of the augmenter 10 which enable the transmission and augmenting of torque are as follows.

A linkage assembly shown generally at 38 is constructed and arranged for operation when the halves 14,16 are joined together. The linkage assembly 38 includes a drive finger 40 and a driven arm 42.

The drive finger 40 has a first end from which an upstanding cylindrical portion 44 extends. The cylindrical portion 44 extends through both halves 14,16 when joined together. The drive finger 40 rotates about the cylindrical portion 44. The cylindrical portion 44 is provided with a hex or other multi-sided aperture 46 (FIG. 2) extending completely therethrough. The aperture 46 is adapted to act as an engaging receptacle for a multi-sided male drive member A. The aperture 46 is constructed and arranged in the drive finger 40 to be in registration with the aperture 28 of the half 14. The half 16 is similarly provided with an aperture which is in registration with the aperture 28 of the half 14, such that when the halves 14,16 are joined to each other with the linkage assembly 38 disposed therebetween, the multi-sided aperture 46 of the drive plate 40 is accessible at the smaller aperture 28 of the half 14 or at the corresponding aperture (not shown) in the other half 16. This permits the user to extend the drive input A completely through the housing 12, or to enable access to the engaging receptacle from either side of the housing. Therefore, the receptacle will always be accessible even if necessary to turn the augmenter 10 over for an operation.

The drive finger 40 is constructed with a side wall generally shown at 48 which substantially conforms to the tapered shape of the inner surface 34 of the side wall 20 of the half 16. As shown in FIG. 3, an arcuate portion of the side wall 48 is constructed to rest against and be received by the complimentary tapered inner surface 34. This permits the drive finger 40 to pivot in position and rest against the side wall 20. However, as will be discussed hereinafter, the drive finger 40 does not exert a pressure load against the side wall 20 which would be sufficient to weaken the side wall 20.

The opposite, free end of the drive finger 40 is formed with an oblong-shaped aperture 50 extending completely therethrough. A longitudinal axis of the oblong-shaped aperture 50 bisects a central axis of the multi-sided aperture 46.

The driven arm 42 includes at one end a pin 52 extending therefrom. The pin 52 is constructed and arranged to be in registration with and received by the oblong-shaped aperture 50 of the drive finger 40. The pin 52 is similarly oblong-shaped and is of a height that preferably is at least equal to the depth of the oblong-shaped aperture 50, and does not exceed the greatest height of the driven arm 42. The pin 52 is rotatably mounted to the driven arm 42. Alternatively, the pin 52 may be circularly shaped and fixed to the driven arm 42.

The driven arm 42 widens as it extends to assume a circular shape. As also shown in the perspective view of FIG. 2, a larger, circular shaped portion of the driven arm 42 is shown generally at 54.

The driven arm 42 is provided with side walls 56 and 57 which are shaped to engage along their entire length or to engage substantially along their entire length the inner surface of the continuous wall 20 of the housing when the driven arm is at the end of its travel. This tends to distribute the forces produced by the side wall of the driven arm 42 along the entire housing, minimizing the stress at any one point.

The shape of the side wall 56 permits the driven arm 42 to pivot freely within the half 16 when the driven arm 42 coacts with the drive finger 40.

An arcuate boss 62 or ridge extends upward from the driven arm 42 to coact with the drive finger 40. The height of the boss 62 substantially corresponds to the thickness of the drive finger 40 for a purpose to be described with reference to FIGS. 4 and 5.

Grooves 58 and 60 respectively are machined in the driven arm leaving ridges 62 and 66, and 64 and 67 respectively. The grooves 58, 60 are adapted to mate with a pair of arcuate ridges. The arcuate ridge on the floor of the top plate is not shown. The arcuate ridge on the bottom half being designated as 36. The coaction of the grooves 60 on the driven arm with the arcuate ridge 36 on the back half of the housing provides a guide for movement of the driven arm and also provides for structural support of the driven arm as it is moved by the drive finger. The top of the ridges 62 and 66 and the front side, and the ridges 64 and 67 on the rear extend to the inner surface of the housing when the halves 14,16 are assembled.

As shown more particularly in FIG. 2, the arcuate guide bar 36 is sized and shaped to be received in the groove 60, while another arcuate guide bar (not shown due to the perspective view of the Figures) of half 14 is received in the groove 58. This construction permits the driven arm 42 to ride along the arcuate guide bar 36 and the prescribed angle of arc of the guide bar 36.

The driven arm 42 widens generally at 66 into a circular portion having an aperture 68 extending completely therethrough and in registration with the large aperture 30 of the plate 14 and the aperture 27 of the plate 16. The circular portion 66 of the driven arm 42 is formed with a recess 70 in communication with the aperture 68. A pair of bores 72,74 are formed in the circular portion 66 of the driven arm 42 and open into the recess 70.

A pawl 76 is disposed in the recess 70. The pawl 76 is formed with a pair of bores 78,80, each of which is in registration with a corresponding one of the bores 72,74 of the driven arm 42. Springs 82,84 are disposed in the recess 70, each one having its opposed ends terminating in a corresponding one of the bores 72,78 and 74,80, respectively. The springs 82,84 resiliently bias the pawl 76 to float in the recess 70 so that inclined teeth 77 of the pawl 76 are urged to engage corresponding inclined teeth 86 of a ratchet 88 disposed in the large aperture 30.

The ratchet 88 fits in a stepped portion of the aperture 68. The aperture 68 has a larger diameter and a smaller diameter. The larger diameter will accommodate the teeth of the rachet and the small diameter will support the teeth and enclose the entire ratchet mechanism.

The ratchet 88 is circular in shape and is received in the large circular end 54 of the driven plate 42 to surround a hex socket 88. The ratchet 88 is connected to and preferably an integral part of the hex socket 90.

A circular shaped wear collar 92 is constructed and arranged to extend around the hex socket 90 above the ratchet teeth 86. The wear collar 92 is made from bronze or other soft alloy to reduce friction during a torque operation when the halves 14,16 are joined to form the housing 12.

The starting position of the torquing operation is shown for example in FIGS. 1 and 3. First, the housing 12 of the augmenter 10 is grasped and the large hex will be engaged with the item to be tightened such as the output shaft B. The handle of the wrench 12 is then manually turned much as a standard socket head wrench until the output shaft is tight and further movement of the handle manually is no longer possible. If augmented torque is required, then an augmenting drive shaft A is entered into the augmenting receptacle aperture 46. The input shaft A can then be rotated. This can either be a long lever, or it can be a power type of unit. However, even a 12 inch additional lever rotating the augmenting receptacle will be sufficient to produce substantial augmenting torque since the lever can be substantially longer than the length of the handle. Additionally, since the handle must be located in a fixed position in a specific location with respect to the output shaft to be tightened, there may not be sufficient room to obtain proper purchase for rotating the handle of the augmenter, whereas an auxiliary lever or rotating bar can extend to an area of greater freedom when using the augmenting feature.

Figure 4:
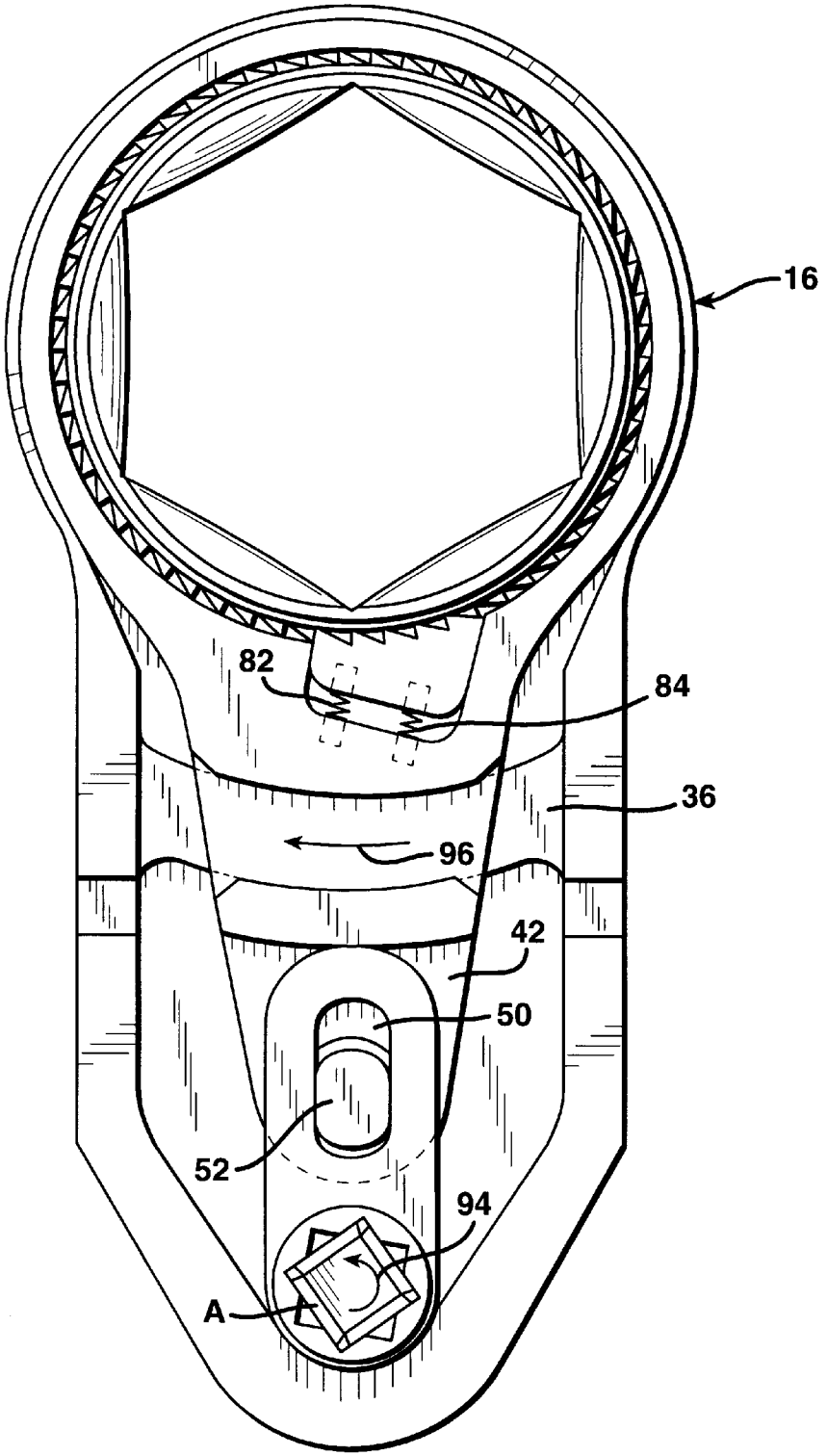
FIG. 4 is a top plan view of elements shown in the view of FIG. 3 coacting for a torque conversion stroke.

The input A is turned as indicated by the arrow 94 shown in FIG. 4. The rotation is in, for example, a counter clockwise direction. Accordingly, the drive finger 40 is also urged to pivot in a counter clockwise direction. The driven arm 42 is urged to move in a direction of arrow 96, while the pin 52 moves along the oblong-shaped aperture 50 of the drive finger 40.

The arcuate guide bar 36 extending upward from the bottom 32 of the plate 16 provides a stress point for the drive finger 40 and the driven arm 42. That is, as the finger and arm 40,42 respectively, are pivoted, there is a tendency for the finger 40 and arm 42 to be forced away from each other which would, but for presence of the guide bar 36, cause a detrimental amount of force to be incurred by the continuous side wall 20 of the plate 16. The guide bar 36 restricts the "parting" of the linkage assembly 38 and channels the stress and forces which occur during the torque operation to a more central location of the plate 16. Such forces are disbursed so that the structural integrity of the halves 14,16, and therefore the housing 12, is not compromised.

Figure 5:
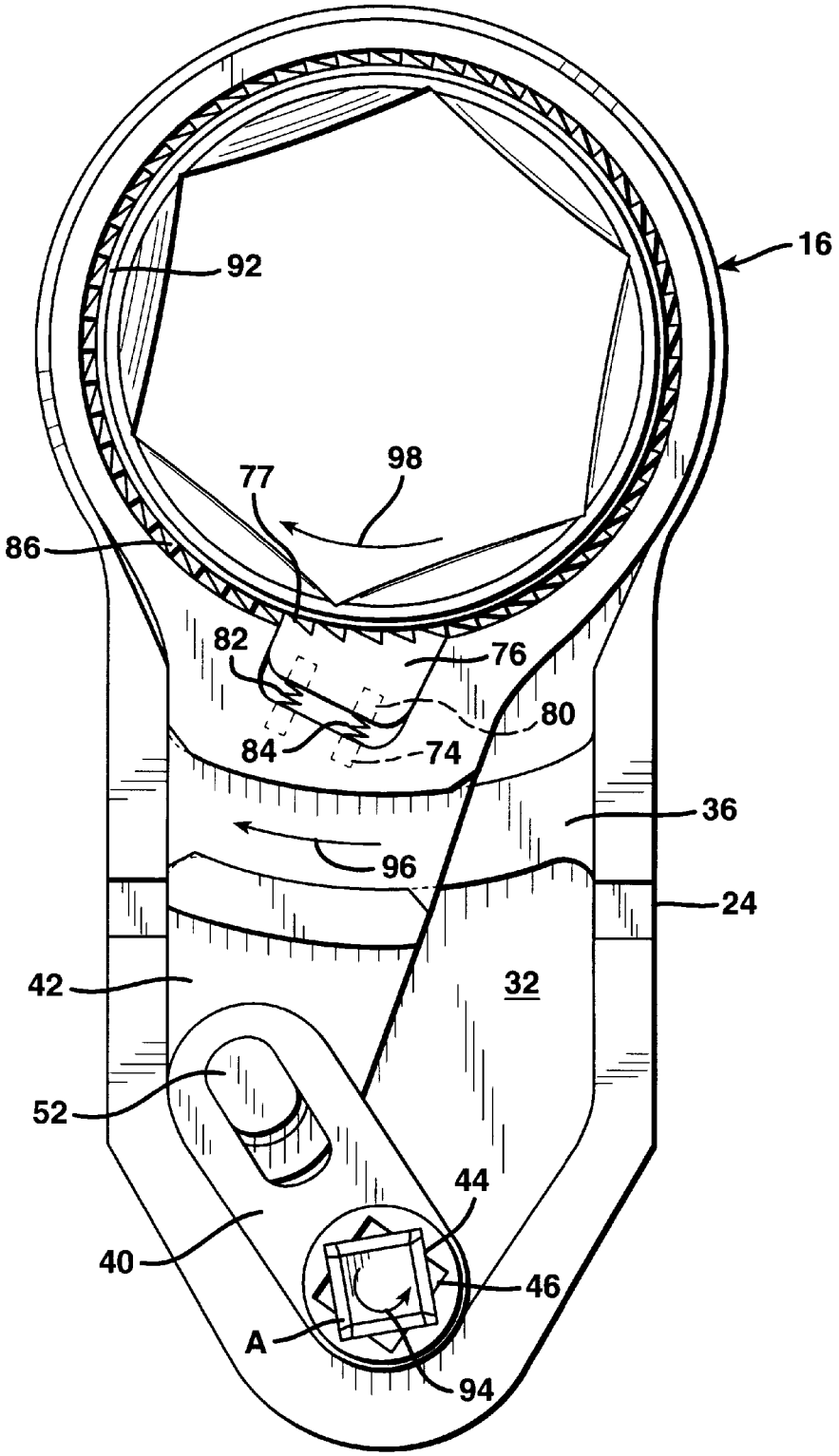
FIG. 5 is a top plan view of the hand wrench of FIG. 4 completing the stroke.

As the linkage assembly 38 is pivoted, the inclined teeth 77 of the pawl 76 engage the corresponding inclined teeth 86 of the ratchet 88. This motion forces the hex socket 90 to pivot as indicated by arrow 98 in FIG. 5 to tighten down the bolt B. The springs 82,84 as shown in FIGS. 4–5, bias the pawl 76 toward the ratchet 88 for engagement of the teeth 77,86. The motion of the linkage assembly 38 is therefore imported to the hex socket 90 to allow effective motion only in the direction as indicated by the arrow 98.

When the "throw" of the linkage assembly 38 is complete, as shown in FIG. 5, the input A is moved in the opposite direction, i.e. clockwise, to return the linkage assembly 38 for another torque operation. This movement permits the inclined teeth 77 of the pawl 76 to ride over the inclined teeth 86 of the ratchet so that the mechanism can be reset as in FIG. 3 for another torque cycle.

Figure 6:
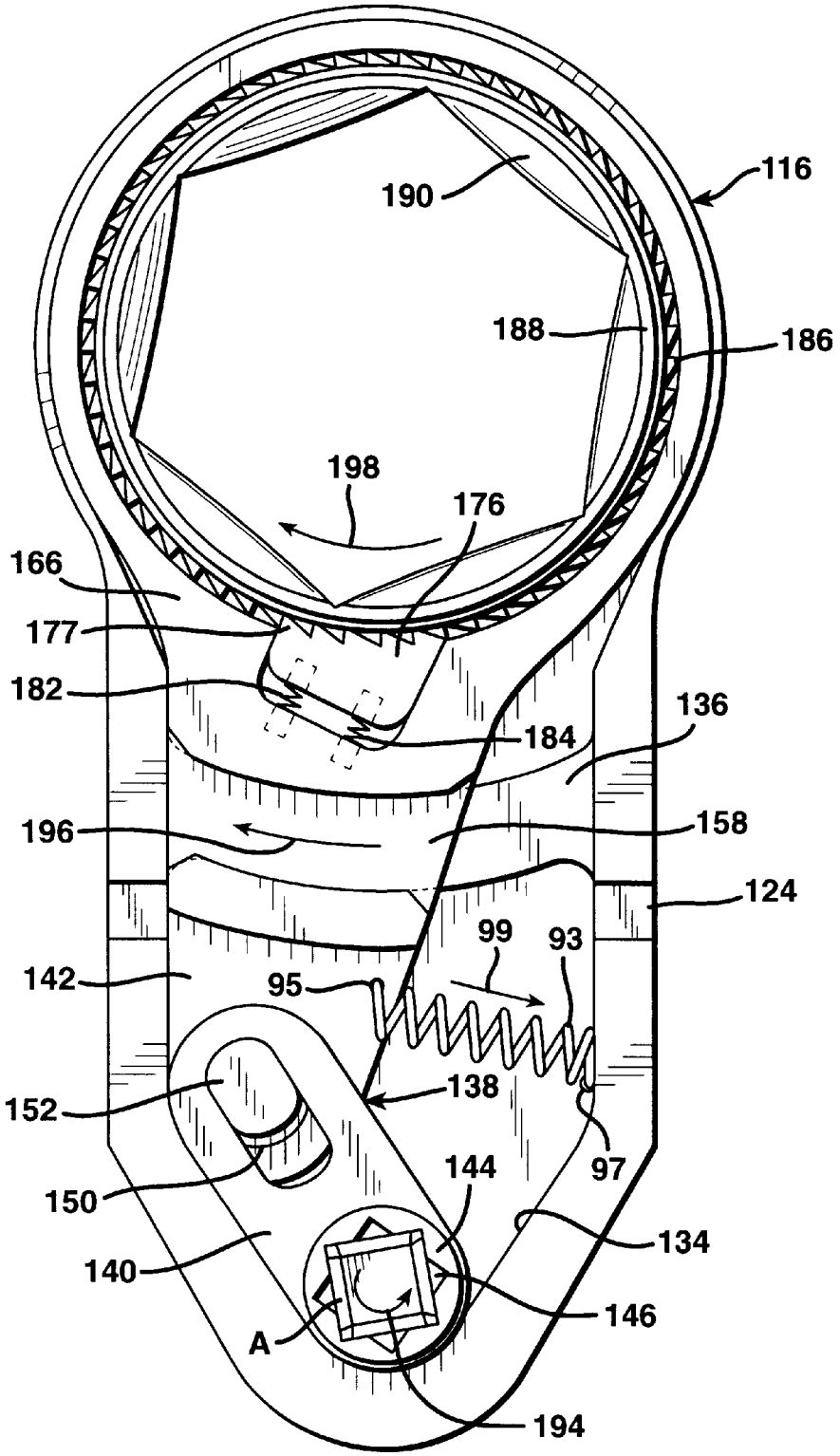
FIG. 6 is a top plan view showing elements of another embodiment of the hand wrench according to the present invention.

Another embodiment of an augmenter 110 constructed in accordance with the present invention is illustrated at FIG. 6. Elements illustrated in FIG. 6 which correspond to elements described above with respect to FIGS. 1–5 have been designated by corresponding reference numerals increased by 100. The embodiment of FIG. 6 is designed for use in a manner similar to that shown with respect to the embodiment of FIGS. 1–5, unless otherwise stated.

Referring now to FIG. 6, an additional biasing element 93 is shown. The biasing element 93 can be an extension spring, as shown in FIG. 6, or a torsion spring. In the example shown, the extension spring 93 has one end 95 connected to the driven arm 142, and an opposite end 97 connected to the continuous side wall 120 of the plate 116. The spring 93 inherently biases the linkage assembly 138 in a direction of arrow 99 to facilitate the return of the linkage assembly 138 to the starting position after the "throw" of the linkage assembly 138 is complete.

The construction and coaction of the drive finger 140 and the driven arm 142 of the linkage assembly 138 is such that a pair of springs 93 can be employed. That is, in addition to the spring 93, another spring (not shown), or a plurality of springs can be attached to the driven arm 142 at an opposite side to which the spring 93 is attached, and then to a corresponding portion of the side wall 120 to facilitate movement of the linkage assembly 138 in either direction.

The augmenter 110 is not limited to having only an extension spring such as that shown in FIG. 6. The device can be constructed with a combination of extension springs and torsion springs to operate as the biasing element 93.

It is preferred to mount the biasing element 93 as shown, as this position is proximate to the region of pivotal coaction between the drive finger 140 and the driven arm 142, thereby most effectively using the biasing force of the spring 93.

Figure 7:
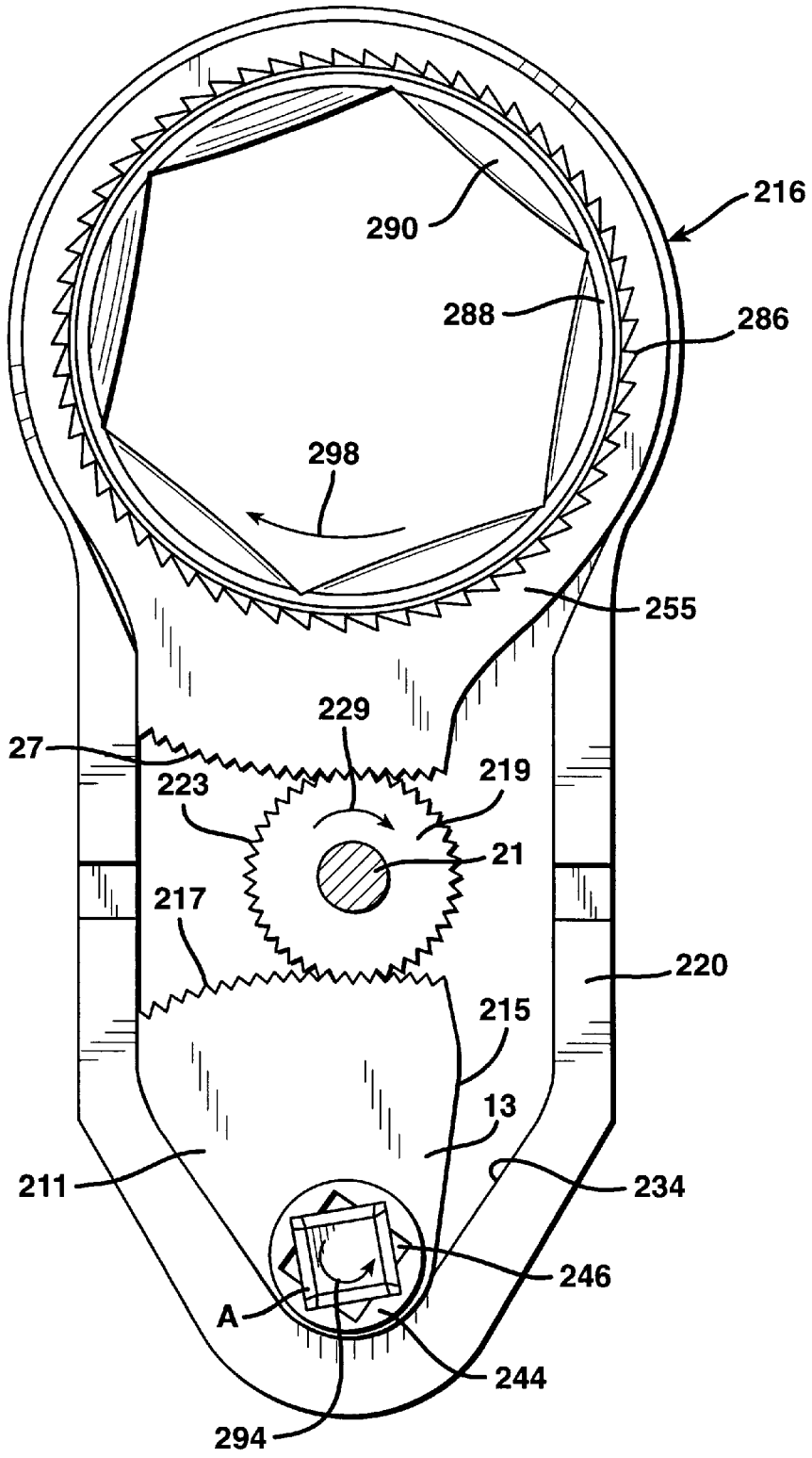
FIG. 7 is a top plan view showing elements of still another embodiment of the hand wrench according to the present invention.

Another embodiment of an augmenter 210 constructed in accordance with the present invention is illustrated at FIG. 7. Elements illustrated in FIG. 7 which correspond to elements described above with respect FIGS. 1–5 have been designated by corresponding reference numerals increased by 200. The embodiment of FIG. 7 is designed for use in a manner similar to that shown with respect to the embodiment of FIGS. 1–5, unless otherwise stated.

In FIG. 7, a drive finger 211 has a first end from which a cylindrical portion 244 extends. The cylindrical portion 244 is provided with a hex or other multi-sided aperture extending completely therethrough. The half 216 is similarly provided with an aperture which is in registration with the aperture 246 of the half 214, such that when the halves 214, 216 are mated, the multi-sided aperture 246 of the drive finger 211 is accessible from an exterior of the half 214. This permits the user to extend the drive input A completely through the housing regardless of the length of the input A. The drive finger 211 is constructed with a side wall generally shown at 13 which substantially conforms to the shape of the upstanding side wall 220 of the half 216.

As shown in FIG. 7, a side wall 215 of the drive finger 211 is constructed to rest against the complimentary shaped side wall 220 extending from the half 216. This permits the drive finger 211 to pivot in position and rest against an inner surface 234 of the side wall 220.

An opposite end of the drive finger 211 is formed with a rack of teeth shown generally at 217. The rack 217 extends completely along this end of the drive finger 211 and is of a particular thickness and pitch for coaction with other elements of this embodiment as discussed below.

A transfer gear 19 is disposed for pivotal movement between the halves 214, 216. The transfer gear 219 is mounted to the half 216 by a pin 221. A plurality of teeth 223 extend along a peripheral edge of the gear 219, which teeth 223 are constructed and arranged for releasable mating engagement and contact between corresponding teeth 217 on the drive finger 211. During a torque operation, at least three or four, and preferably five of the teeth 217,223 on the drive finger 211 and the transfer gear 219, respectively, are in contact to provide strength and stability during the torque operation.

The driven arm 225 in FIG. 7 is provided with a rack of teeth 227 extending along a peripheral edge of a portion thereof. The pitch of the teeth on the rack 227 of the driven arm 225 is equal to the pitch on the teeth 217 on the driven arm 211. The rack of teeth 227 is of a thickness and pitch to facilitate releasable mating contact with the teeth 223 of the transfer gear 219. At least three or four, and preferably five teeth of the transfer gear 219 and driven arm 225 mesh during a torque operation to facilitate strength and stability of the device during the operation.

Springs (not shown) can also be used with the embodiment of FIG. 7 to bias the drive finger 211 and driven arm 225 to their selective positions.

The embodiment of FIG. 7 operates as follows.

The drive input A is inserted into the aperture 246 and turned in the direction of arrow 294. The drive finger 211 is moved in a counter-clockwise direction with the teeth 217 thereof in engagement with the teeth 223 of the transfer gear 219. The transfer gear 219 in turn rotates in a clockwise direction as shown by the arrow 229. This motion of the transfer gear 219 causes the conversion plate 225 to move in a clockwise direction as indicated by the arrow 298 to impart a rotational movement to the teeth 286 of the ratchet 288. The hex socket 290 is also moved in a clockwise direction to turn the bolt or stud being tensioned. When the hexnut 290 has been turned down on the bolt or stud through a complete "throw" of the turning operation, the device is returned by the user in an opposite direction for the conversion plate to ride over the teeth 286 to prepare for a subsequent torquing operation during which the teeth 286 of the ratchet 288 are engaged to subsequently cause the hexnut 290 to tighten down the bolt.

The height of drive finger 211 and driven arm 225, in combination with locking means (not shown) for the housing function as a guide for 211,225.

The construction of the teeth used for the drive plate 211, transfer gear 219 and driven arm 225, are selected for gear backlash to be within tolerable limits so that slippage is reduced as much as possible upon reversal of the gear rotation.

As shown in FIGS. 1–5, the wrench with augmenting device can be used as a simple hand wrench tool to either tighten or loosen nuts to another fastener. The socket of the wrench is fitted over the item to be loosened or tightened in the same manner that a ratchet type socket wrench would be fitted over any standard item to be wrenched. Note that nesting sockets (not shown but well known in the art) could be used to modify the size of the engaging socket in order to give the tool a wider range of operative use. The tool also has a relatively narrow rim between the socket and the outer edge of the tool surrounding the socket. This enables the tool to be placed into relatively narrow areas which is often the case with bolting circles and other areas which provide limited access for the worker. The tool is then operated as a standard ratchet socket wrench. The handle is rotated about the socket to loosen or tighten the item that is to be wrenched. In an instance where a high torque is necessary; either to "break" or dislodge a nut or other fastener which tends to become frozen in place, or to "snug up" the item to be tightened when it is no longer possible to easily move the handle of the wrench, then the augmenting feature of the wrench is employed. A mating drive fits into the drive socket or receptacle in the bottom of the handle. This drive implement can be a relatively long bar or it can be connected to the output drive of a mechanical or pneumatic device. The auxiliary drive member is then actuated to rotate the driven socket in the handle, which actuates the linkage in the handle of the wrench to rotate the socket through a limited angle as discussed. This limited angle will be sufficient to tighten or loosen the item that is being acted upon by the wrench. If it turns out that the linkage in the handle of the wrench has "stopped out" or run its full travel without reaching the desired level of torque being applied by the actuating socket of the wrench then the auxiliary torque apparatus can be reversed. The rachet feature of the wrench, will allow the linkage within the handle to return to the initial position. The auxiliary torque apparatus does not have to be removed from the drive socket at the bottom of the handle, but merely rotated in a direction opposite to the force applying direction because the ratchet feature will allow the linkage within the handle to return to its initial position.

The wrench of course can be used to tighten or loosen, merely by turning the wrench over, and using one face for turning in a clockwise direction and the other face for turning in a counter clock-wise direction. As shown in FIGS. 2–5, the front and back halves of the housing have ridges which coact with and guide the grooves in the driven arm of the linkage over a relatively wide area. Additionally, the sides of the driven arm are shaped to conform with or abut the interior side walls of the linkage along a long length of the driven arm. This will tend to dissipate the force that will be applied to the housing by the linkage when the linkage is "stopped out" at the end of its travel. Similarly, the pin arrangement and slotted drive finger allow for relatively wide contact surfaces to minimize wear. The ridges or raised portions on the driven arm which surround the rachet at the lower end which form the groove for the ridges from the housing act as a stiffening member when the halves are assembled to provide strength for the handle making the tool relatively rugged but still operable.

The ratchet and socket arrangement is relatively simple and reliable, and the wear features of the construction insure not only that the life of the tool will be relatively long, but its operation will be relatively easy.

Shown in FIG. 6 are a variety of springs which can also be used to bias the driven arm of the apparatus. The springs can be compression springs or torsion springs.

As shown in FIG. 7, the apparatus can also be built in a variety of ways such as by use of an idler gear between two gear racks, which replaces the linkage.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. A wrench with torque augmenting means, comprising:

a housing;

torque input means accessible in the housing;

torque output means accessible in the housing and separate from the torque input means, the torque output means adapted to engage an object to which torque will be applied; and linkage means for linking the torque input means with the torque output means for coaction therebetween, the linkage means disposed in the housing and adapted for sliding coaction between the torque input means and the torque output means to cause a first amount of torque introduced at the torque input means to produce a second amount of torque available at the torque output means.

2. The wrench according to claim 1, wherein the housing comprises:

an interior surface constructed and arranged as a stop for the sliding coaction of the linkage means.

3. The wrench according to claim 1, wherein the linkage means is constructed and arranged with respect to the housing to coact with the torque output means to enable repetitive rotation through angles of arc with the housing remaining stationary.

4. The wrench according to claim 1, wherein the housing comprises:

a handle;

a ratchet disposed in the handle for coaction with the torque output means;

the torque input means disposed in a portion of the handle remote from the ratchet and providing access to a driven socket at the torque input means; and the linkage means disposed within the handle.

5. The wrench according to claim 2, wherein the housing comprises:

a first half with a first interior bottom surface extending to a first continuous side wall along the first half;

a second half with a second interior bottom surface extending to a second continuous side wall along the second half; and means to releasably engage the first half and the second half with each other to contain the torque input means, torque output means and linkage means within the housing.

6. The wrench according to claim 5, wherein the housing further comprises:

a first pair of cut-outs formed at opposed sides of the first continuous side wall of the first half, and a second pair of cut-outs formed at opposed sides of the second continuous side wall of the second half; and means to releasably engage the first half and the second half with each other for the first pair of cut-outs to be in registration with the second pair of cut-outs to provide a pair of spaces at opposite sides of the housing to part the housing.

7. The wrench according to claim 5, further comprising:

a first arcuate guide bar extending from the first interior bottom surface and spanning the first half between the torque output means and the torque input means, such that each opposed end of the first arcuate guide bar is connected to a corresponding portion of the first continuous side wall; and a second arcuate guide bar extending from the second interior bottom surface and spanning the second half, such that each opposed end of the second arcuate guide bar is connected to a corresponding portion of the second continuous side wall.

8. The wrench according to claim 1, wherein the linkage means comprises:

a driving lever operatively associated with the torque output means;

a driven lever operatively associated with the torque input means; and a sliding means constructed and arranged for coaction with the driving lever and the driven lever for permitting the levers to slide along an interior of the housing.

9. The wrench according to claim 8, wherein the sliding means comprises:

a pin extending from one of the driving lever and the driven lever; and an aperture in the other one of the driving lever and the driven lever for receiving the pin for movement in the aperture.

10. The wrench according to claim 1, wherein the linkage means comprises:

a pawl disposed in the housing for coaction with the torque output means.

11. The wrench according to claim 10, further comprising:

spring means operatively associated with the pawl to resiliently urge the pawl into coaction with the torque output means.

12. The wrench according to claim 1, further comprising:

resilient means connected to the linkage means for returning the linkage means to a previous position after a rotation of the torque output means.

13. The wrench according to claim 12, wherein the resilient means comprises:

at least one spring means connecting the linkage means with the housing.

14. A wrench with torque augmenting means, comprising:

a housing having:

a first half with a first interior bottom surface extending to a first continuous side wall along the first half, a first drive input aperture extending through the first half, a first drive output aperture extending through the first half and separate from the first drive input aperture, a first pair of cutouts formed at opposed sides of the first continuous side wall of the first half, a first arcuate guide bar extending from the first interior bottom surface and spanning the first half between the first drive input and the first drive output, such that each opposed end of the first arcuate guide bar is connected to a corresponding portion of the first continuous side wall;

a second half with a second interior bottom surface extending to a second continuous side wall along the second half, a second drive input aperture extending through the second half, a second drive output aperture extending through the second half and separate from the second drive input aperture, a second pair of cutouts formed at opposed sides of the second continuous side wall of the second half, a second arcuate guide bar extending from the second interior bottom surface and spanning the second half, such that each opposed end of the second arcuate guide bar is connected to a corresponding portion of the second continuous side wall, means to releasably engage the first half and second half with each other for the first pair of cutouts to be in registration with the second pair of cutouts to provide a pair of opposed spaces at opposite sides of the housing to part the housing, the first and second drive input apertures to be in registration with each other, the first and second drive output apertures to be in registration with each other, and for the first and second arcuate guide bars to be in registration with each other;

a first drive member having:

an oblong-shaped aperture extending through the first drive member, a first socket extending from the first drive member, separate and discrete from the oblong-shaped aperture, an exterior side wall conforming substantially to a portion of an interior surface of the first continuous side wall, the first socket constructed and arranged on the first member for registration with the first and second drive input apertures when the first and second halves are engaged;

a second driven member having:

a pin extending from the second driven member for coaction with the oblong-shaped aperture of the first drive member, the pin having a height at least equal to the depth of the oblong-shaped aperture, a second aperture extending through the second driven member separate and discrete from the pin, a second socket disposed in the second aperture, the second socket having:

a plurality of inclined teeth circumscribing the second socket forming a ratchet, a wear ring circumscribing the second socket and resting upon the plurality of inclined teeth of the second socket;

a recess formed in the second driven member;

a pawl disposed in the recess for movement therein, the pawl adapted to coact with the rachet;

a first pair of bores formed in the second member, each of the first pair of bores opening into the recess;

a second pair of bores formed in the pawl, each of the second pair of bores opening to face the recess for registration with the first pair of bores;

spring means disposed in said first and second pairs of bores to resiliently urge the pawl into coaction with the ratchet;

a first arcuate groove extending across a first surface of the second driven member;

a second arcuate groove extending across a second surface of the second driven member in registration with the first arcuate groove at an opposed side of the second driven member;

one of the first and second arcuate grooves receiving and coacting with the first arcuate guide bar, and the other of the first and second arcuate grooves receiving and coacting with the second arcuate guide bar when the first and second halves are engaged to guide pivotal movement of the second driven member along the first and second arcuate guide bars; and rotation of the first socket coacting with the first drive member to impart motion to the second driven member to pivot along the first and second arcuate guide bars for the pawl to engage the teeth of the ratchet at the second socket and rotate the second socket at the first and second drive outputs.

15. An augmenting wrench, comprising:

a housing;

a driving socket in the housing;

a ratchet in the housing coacting with the driving socket;

means for grasping the housing to rotate the housing about the driving socket to cause wrenching action of the driving socket when the driving socket is engaged with an object to be wrenched;

a driven socket in the housing; and linkage means within the housing connecting the driving socket with the driven socket, the linkage means slidably coacting with the ratchet and the driven socket to enable rotation of the driven socket to transfer torque to the driving socket while the housing remains stationary, wherein the linkage means includes:

a driven link operatively associated with the driven socket, a driving link operatively associated with the driving socket, and a sliding surface means constructed and arranged for coaction with the driven link and the driving link for providing sliding coaction therebetween to transfer torque from the driven socket to the driving socket.

16. The wrench according to claim 15, wherein the linkage means is constructed and arranged with respect to the housing to coact with the ratchet of the driving socket to enable repetitive rotation through angles of arc without movement of the housing.

17. The wrench according to claim 15, wherein the housing includes:

a handle;

a torque input means disposed in the portion of the handle remote from the ratchet and providing access to the driven socket; and the linkage means disposed within the handle.

18. The wrench according to claim 15, wherein the housing includes:

a first half with a first interior bottom surface extending to a first continuous side wall along the first half;

a second half with a second interior bottom surface extending to a second continuous side wall along the second half; and means to releasably engage the first half and the second half with each other to contain the driving socket, ratchet, driven socket, and linkage means within the housing.

19. The wrench according to claim 18, wherein the housing includes:

a first pair of cut-outs formed at opposed sides of the first continuous side wall of the first half, and a second pair of cutouts formed at opposed sides of the second continuous side wall of the second half; and means to releasably engage the first half and the second half with each other for the first pair of cutouts to be in registration with the second pair of cutouts to provide a pair of spaces at opposite sides of the housing to part the housing.

20. The wrench according to claim 19, further including:

a first arcuate guide bar extending from the first interior bottom surface and spanning the first half between the driving socket and the driven socket, such that each opposed end of the first arcuate guide bar is connected to a corresponding portion of the first continuous side wall; and a second arcuate guide bar extending from the second interior bottom surface and spanning the second half, such that each opposed end of the second arcuate guide bar is connected to a corresponding portion of the second continuous side wall.

21. The wrench according to claim 15, wherein the sliding surface means comprises:

pin means projecting from one of the driving link and the driven link; and an aperture constructed and arranged in the other one of the driven link and the driving link to receive the pin means, the aperture adapted to permit the pin means to move along the aperture.

22. The wrench according to claim 21, wherein the pin means has a height at least equal to the depth of the aperture.

23. The wrench according to claim 21, wherein the pin means is constructed with a circular cross section and the aperture is oblong-shaped.

24. The wrench according to claim 21, wherein the linkage means further comprises:

a pawl disposed in the housing for coaction with the ratchet of the driving socket.

25. The wrench according to claim 24, further including:

spring means operatively associated with the pawl to resiliently urge the pawl into coaction with the ratchet.

26. The wrench according to claim 15, further comprising:

resilient means connected to the linkage means for returning the linkage means to a previous position after a rotation of the driving socket.

27. The wrench according to claim 26, wherein the resilient means comprises:

at least one spring means connecting the linkage means with the housing.

28. An augmenting wrench, comprising:

a housing;

a driving socket in the housing;

a ratchet in the housing coacting with the driving socket;

means for grasping the housing to rotate the housing about the driving socket to cause wrenching action of the driving socket when the driving socket is engaged with an object to be wrenched;

a driven socket in the housing; and gear means disposed in the housing between the driving socket and the driven socket for rotational coaction with the ratchet and the driven socket to transfer torque from the driven socket to the driving socket.

29. An augmenting wrench, comprising:

a housing including:

a first half with a first interior bottom surface extending to a first continuous side wall along the first half, a first pair of cut-outs formed at opposed sides of the first continuous side wall of the first half, a second half with a second interior bottom surface extending to a second continuous side wall along the second half, a second pair of cut-outs formed at opposed sides of the second continuous side wall of the second half, and means for releasably engaging the first half and the second half with each other for the first pair of cut-outs to be in registration with the second pair of cut-outs to provide a pair of spaces at opposite sides of the housing to part the housing;

a driving socket in the housing;

a ratchet in the housing coacting with the driving socket;

means for grasping the housing to rotate the housing about the driving socket to cause wrenching action of the driving socket when the driving socket is engaged with an object to be wrenched;

a driven socket in the housing;

a first arcuate guide bar extending from the first interior bottom surface and spanning the first half between the driving socket and the driven socket, such that each opposed end of the first arcuate guide bar is connected to a corresponding portion of the first continuous side wall;

a second arcuate guide bar extending from the second interior bottom surface and spanning the second half, such that each opposed end of the second arcuate guide bar is connecting a corresponding portion of the second continuous side wall; and linkage means within the housing connecting the driving socket with the driven socket, the linkage means coacting with the ratchet and the driven socket to enable rotation of the driven socket to transfer torque to the driving socket without movement of the housing.

30. The wrench according to claim 29, wherein the linkage means comprises:

a driving arm operatively associated with the driving socket, the driving arm including:

pin means projecting from driving arm;

a driven finger operatively associated with the driven socket, the driven finger including:

an aperture constructed and arranged in the driven finger to receive the pin means of the driving arm, the aperture adapted to permit the pin means to move along the aperture.

31. The wrench according to claim 30, wherein the pin means has a height at least equal to the depth of the aperture.

32. The wrench according to claim 30, wherein the pin means is constructed with a circular cross-section and the aperture is oblong-shaped.

33. The wrench according to claim 30, wherein the linkage means further comprises:

a pawl disposed in the housing for coaction with the ratchet of the driving socket.

34. The wrench according to claim 33, further comprising:

spring means operatively associated with the pawl to resiliently urge the pawl into coaction with the ratchet.

35. A method of tightening a fastener, the method comprising the steps of:

engaging a socket of a wrench having a handle with a fastener to which torque is applied;

rotating the handle to turn the engaging socket to apply a first amount of torque to the fastener;

maintaining the housing in a stationery position;

rotating a linkage means within the handle for slidably coacting with the engaging socket to rotate the engaging socket to apply to the fastener a second amount of torque higher than the first amount of torque.

36. The method according to claim 35, further including the step of:

rotating the handle manually through several passes using ratchet means in the handle coacting with the engaging socket.

37. The method according to claim 36, further including the step of:

rotating a driven socket in the handle coacting with the linkage.

38. The method according to claim 37, further including the step of:

rotating the driven socket through several passes without movement of the handle by coaction between the driven socket and the ratchet in the housing.

* * * * *